US010578044B2

(12) United States Patent
Elmerich et al.

(10) Patent No.: US 10,578,044 B2
(45) Date of Patent: Mar. 3, 2020

(54) METHOD FOR DIAGNOSING AN OXYGEN PROBE

(71) Applicant: CONTINENTAL AUTOMOTIVE FRANCE S.A.S., Toulouse (FR)

(72) Inventors: Bastien Elmerich, Suresnes (FR); Frèdèric Cousin, Saint Gratien (FR); Thomas Mauge, La Garenne Colombes (FR); Alexandre Jhean, Paris (FR)

(73) Assignee: CONTINENTAL AUTOMOTIVE FRANCE S.A.S., Toulouse (FR)

( * ) Notice: Subject to any disclaimer, the term of this patent is extended or adjusted under 35 U.S.C. 154(b) by 0 days.

(21) Appl. No.: 16/062,908

(22) PCT Filed: Dec. 19, 2016

(86) PCT No.: PCT/FR2016/053551

§ 371 (c)(1),
(2) Date: Jun. 15, 2018

(87) PCT Pub. No.: WO2017/103551

PCT Pub. Date: Jun. 22, 2017

(65) Prior Publication Data

US 2018/0372015 A1 Dec. 27, 2018

(30) Foreign Application Priority Data

Dec. 18, 2015 (FR) ..... 15 62760

(51) Int. Cl.
*F02D 41/22* (2006.01)
*F02D 41/12* (2006.01)
(Continued)

(52) U.S. Cl.
CPC ..... *F02D 41/222* (2013.01); *F01N 11/007* (2013.01); *F02D 41/123* (2013.01);
(Continued)

(58) Field of Classification Search
CPC .. F02D 41/222; F02D 41/123; F02D 41/1453; F02D 2200/0816; F02D 2200/0406; F01N 11/007
See application file for complete search history.

(56) References Cited

U.S. PATENT DOCUMENTS 6,131,446 A * 10/2000 Schnaibel ..... F02D 41/1441 60/276
6,282,889 B1 * 9/2001 Kakuyama ..... F02D 41/0295 60/274

(Continued)

FOREIGN PATENT DOCUMENTS

| | | |
|---|---|---|
| DE | 197 22 334 | 12/1998 |
| DE | 10 2008 007 459 | 8/2008 |
| WO | WO 2014/207843 | 12/2014 |

OTHER PUBLICATIONS

International Search Report, PCT/FR2016/053551, dated Feb. 24, 2017.

*Primary Examiner* — Joseph J Dallo
(74) *Attorney, Agent, or Firm* — Young & Thompson

(57) ABSTRACT

Disclosed is a method for diagnosis of an oxygen probe for a combustion engine, with the steps: When an engine's fuel injection is inactive, measuring the output electric voltage from the oxygen probe; If the measured output electrical voltage of the oxygen probe is greater than a predetermined minimum voltage threshold, measuring a pressure prevailing in an intake distributor of the engine; If the measured pressure in the intake distributor is less than a predetermined minimum pressure threshold, increasing the pressure to a value greater than the predetermined minimum pressure threshold; Determining the time period between the time when the output electrical voltage of the probe falls below a second predetermined voltage threshold and the time when the output electrical voltage of the probe falls below a third predetermined voltage threshold; and diagnosing the oxygen probe depending on elapsed the time period.

20 Claims, 3 Drawing Sheets

(51) Int. Cl.
*F02D 41/14* (2006.01)
*F01N 11/00* (2006.01)

(52) U.S. Cl.
CPC .. *F02D 41/1453* (2013.01); *F02D 2200/0406* (2013.01); *F02D 2200/0816* (2013.01)

(56) References Cited

U.S. PATENT DOCUMENTS

| | | | | |
|---|---|---|---|---|
| 9,945,310 | B1 * | 4/2018 | McQuillen | F02M 26/14 |
| 2003/0089164 | A1 * | 5/2003 | Bonadies | F02D 41/1441 73/114.39 |
| 2013/0085652 | A1 * | 4/2013 | McGuffin | F02M 37/00 701/101 |
| 2015/0075502 | A1 * | 3/2015 | Surnilla | F02M 25/08 123/520 |
| 2015/0075503 | A1 * | 3/2015 | Surnilla | F02M 25/0854 123/520 |
| 2016/0138506 | A1 | 5/2016 | Miyamoto et al. | |
| 2017/0082038 | A1 * | 3/2017 | Dudar | F02M 25/0836 |
| 2017/0107918 | A1 * | 4/2017 | Hakeem | F02P 5/152 |
| 2018/0171934 | A1 * | 6/2018 | McQuillen | F02M 25/0227 |
| 2018/0171935 | A1 * | 6/2018 | McQuillen | F02M 25/0227 |
| 2018/0171936 | A1 * | 6/2018 | McQuillen | F02M 25/0227 |

* cited by examiner

METHOD FOR DIAGNOSING AN OXYGEN PROBE

BACKGROUND OF THE INVENTION

Field of the Invention

This invention relates to a method for diagnosing an oxygen probe for a combustion engine, specifically for motor vehicles.

Description of the Related Art

In order to meet pollutant emission standards, vehicles on the market are equipped with a cleanup system which converts a large amount of the pollutants contained in exhaust gases. This cleanup system contains a catalyst. Vehicle certification standards require that the system which controls engine operation monitors the good operation of the catalyst over the entire operating lifetime of the vehicle.

A well-known method for doing this is to use an oxygen probe disposed in the exhaust circuit, downstream of the catalyst. "Downstream" means that the exhaust gases pass first through the catalyst before reaching the oxygen probe. Hereinafter, we will refer to this oxygen probe as the "downstream probe." This type of probe delivers an electric voltage that changes widely regarding the amount of oxygen present in the gas that surrounds it. The analysis, based on engine operating conditions, of the signal delivered by the downstream probe, allows calculation of the conversion rate of the pollutants by the catalyst. We refer to the catalyst diagnostic function; i.e. the system evaluates the efficiency of the catalyst, and informs the driver of a malfunction if one occurs.

A prerequisite to a correct diagnosis of the catalyst is to have a reliable downstream probe signal. Also, it is well-known to perform a diagnosis of the downstream probe before obtaining a successful diagnosis of the catalyst.

Thus, several operating criteria of the downstream probe are analyzed. One of these is the switching time, i.e. the time needed for the probe to change from a first electric voltage level to a second one, while the composition of the exhaust gases is changing from rich to lean or vice-versa.

This switching time reflects the downstream probe's reaction speed. When the switching time is too long, this means that the reaction speed of the downstream probe is insufficient; and that the probe is, therefore, defective.

In practice, the switching time of a probe operating nominally, that is to say, in good operating condition, depends on engine operating condition. Thus, it can be difficult to precisely define the acceptable switching time limit for the probe, since this can be subject to significant dispersion.

BRIEF SUMMARY OF THE INVENTION

The object of this invention is, by using an improved diagnosis method, to improve the reliability of the diagnosis made by the downstream probe.

To this end, the invention proposes a diagnosed method for an oxygen probe, comprising the following steps:

When an engine's fuel injection is inactive, measuring the output electric voltage from the oxygen probe (step 51), If the measured output electrical voltage of the oxygen probe is greater than a predetermined minimum voltage threshold, measuring a pressure prevailing in an intake distributor of the engine (step 52), If the measured pressure in the intake distributor is less than a predetermined minimum pressure threshold, increasing the pressure to a value greater than the predetermined minimum pressure threshold (step 53), Determining the time period between the time when the output electrical voltage of the probe falls below a second predetermined voltage threshold and the time when the output electrical voltage of the probe falls below a third predetermined voltage threshold (V3) (step 54), and diagnosing the oxygen probe depending on elapsed the time period (step 55).

This method is implemented only when the probe delivers an electric voltage higher than a minimum threshold; that is, when the gas composition is a rich mixture.

If the pressure measured in the intake distributor is insufficient, this pressure is increased using means detailed below.

The transition time required for the electric voltage of the probe to reach the third electric voltage threshold from the second electric voltage threshold is determined and will allow to directly obtain the state of the oxygen probe.

By ensuring a minimum pressure in the intake distributor, the dispersion that affects the switching time of the oxygen probe is reduced. Thus, the reliability of the diagnosis is improved.

According to a preferred embodiment, an increase of the pressure measured in the intake distributor is obtained by changing the angular position of a rotary flap disposed at the entry point of the intake distributor, an increase in the angular position of the flap increasing the pressure in the distributor. Action on the angular position of the flap makes it possible to quickly and accurately change the amount of pressure in the intake distributor.

Alternatively, or additionally, the pressure measured in the intake distributor can be increased by changing the angular phasing between the camshaft and the crankshaft, with the camshaft actuating the engine's intake valves.

Still alternatively or additionally, the pressure measured in the intake distributor can be increased by changing the angular phasing between the camshaft and crankshaft, with the camshaft actuating the engine's exhaust valves.

The pressure in the intake distributor can be changed by changing the timing of the opening and closing of the valves. This method can be used either with the valves controlling the intake phase of the four-stroke cycle or with the valves controlling the exhaust phase of the four-stroke cycle, or both together. In addition, this action can be combined with action on the opening of the intake flap.

Ideally, the diagnosis method involves the following step:

If the time period is greater than a maximum predetermined threshold, diagnosing that oxygen probe has a reaction time that is abnormally slow.

As the probe ages, its reaction time tends to increase, because its structure becomes less permeable to oxygen. When the switching time becomes greater than the maximum permissible threshold, the probe is considered to be defective, because its reaction time is too slow.

According to a preferred embodiment, the predetermined minimum pressure threshold depends on the engine rpm. The dispersion affecting the transition time of the oxygen probe is strongly affected by the engine rpm. By varying the minimum pressure based on rpm during the oxygen probe diagnosis phase, it is possible to improve the reliability of the diagnosis over the range of rpm.

Ideally, the second predetermined electric voltage threshold is between 500 and 700 millivolts, preferably between 580 and 620 millivolts. This threshold is close to the electric voltage delivered when there is almost no oxygen in the exhaust gas, i.e. when the mixture is rich.

Ideally, the third predetermined probe electric voltage threshold is between 200 and 400 millivolts, preferably between 280 and 320 millivolts. This threshold is at a level close to that of the electric voltage delivered when the oxygen concentration is close to that of the ambient air, i.e. when there is no combustion in the engine.

Preferably, the diagnosis method includes the following step:

before measuring the output electric voltage of the oxygen probe, checking that an estimated temperature of the oxygen probe is greater than a predetermined minimum threshold temperature (step 50).

The behavior of the probe is not representative if it has not reached its operating temperature. It cannot, therefore, perform the diagnosis of the probe until it reaches a temperature close to its nominal temperature.

According to one embodiment, the oxygen probe is disposed downstream of a pollutant conversion catalyst. Thus, diagnosing the probe is a prerequisite for diagnosing the catalytic converter.

The invention also involves a diagnosis unit that uses a method such as that described above.

The invention also relates to an assembly comprising:

A combustion engine, having an exhaust system in which is disposed an oxygen probe arranged to provide a variable output electric voltage based on the oxygen concentration of the gases passing through the exhaust system, a diagnosis unit, according to the preceding claim, arranged to diagnose the operating of the oxygen probe.

According to a preferred embodiment, the engine is of the type with controlled ignition.

According to one embodiment, the combustion engine is direct-ignition.

According to one embodiment, the combustion engine is supplied with fuel in a gaseous state.

According to one embodiment, the combustion engine contains a supercharging device that increases the pressure of the gases upstream of their intake into the engine. Engine performance, such as torque and maximum power, are improved.

According to one embodiment, the combustion engine contains a recirculation system for recirculating a part of the gas passing through the exhaust system toward the intake system. This technology is particularly efficient in reducing thermal stresses caused by overheating.

BRIEF DESCRIPTION OF THE DRAWINGS

The invention will be more readily understood upon reviewing the figures.

DETAILED DESCRIPTION OF THE PREFERRED EMBODIMENTS

Figure 1:
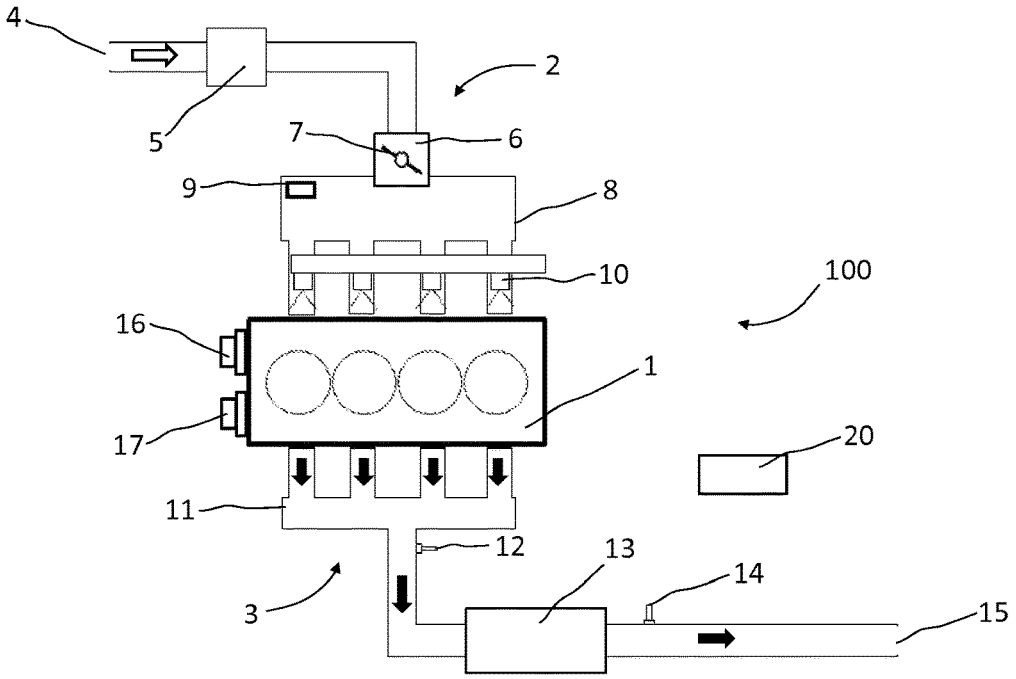
FIG. 1 schematically represents an assembly according an example of the implementation of the invention.
Figure 2:
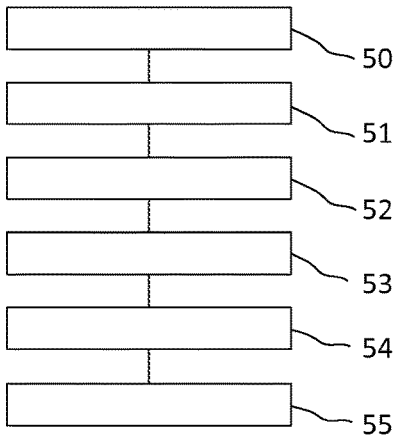
FIG. 2 is a block diagram depicting the different steps of the method implemented according to the invention.

FIG. 1 shows an assembly 100 containing:

A combustion engine 1, the combustion engine 1 having an exhaust system 3 in which is disposed an oxygen probe 14 arranged to deliver a variable output electric voltage based on the oxygen concentration of the gases passing through the exhaust system, A diagnosis unit 20, arranged to diagnose the functioning of the oxygen probe 14.

The combustion engine 1 is a of the type with controlled ignition.

It operates in the classic manner for an internal combustion engine. The engine 1 comprises a fuel intake system 2 and an exhaust system 3 for the gases resulting from the combustion. The fuel is provided to the engine by the injection nozzles 10, which feed each of the engine cylinders. For simplicity, the other components of the fuel supply system are not shown.

Fresh air is admitted into the intake system 2 through the air intake 4, passes through the air filter 5, and enters the throttle valve 6 located at the entry of the intake distributor 8.

The throttle valve comprises a rotary flap 7, which can pivot between a closed position that closes the entry of the intake distributor 8, and a fully open position that allows free access to it.

An absolute pressure probe 9, which allows the pressure within the intake distributor 8 to be measured, is disposed inside the intake distributor 8.

Camshaft phase shift actuators 16 and 17 are provided respectively on the camshaft, managing the opening and closing of the intake valves, and on the camshaft actuating the opening and closing of the exhaust valves. It is thus possible to vary the angular phasing of the valve control.

The exhaust gases resulting from the combustion of the fuel mixture in each of the engine cylinders are collected in the exhaust distributor 11. They then pass through a pollution control device 13 containing a catalyst, which converts most of the pollutants by oxidation and reduction reactions. The exhaust gases are finally expelled outside at the exhaust outlet 15.

An oxygen probe 12 is disposed upstream of the pollution control device 13. The signal from this "upstream" oxygen probe controls the composition ratio of the gas around its stoichiometric composition.

The operating principle of an oxygen probe is well known to the skilled person and will not be described in detail. Briefly, the oxygen probe delivers an output electric voltage of about 100 millivolts when the gas surrounding the probe contains an excess of oxygen, corresponding to a lean mixture, and delivers a voltage output of about 700 millivolts when there is virtually no oxygen, corresponding to a rich mixture.

To recap, a mixture is said to be rich when the amount of fuel is greater than the amount required to obtain the stoichiometric composition of the air/fuel mixture, which is equivalent to saying that the mixture has an excess of fuel for its stoichiometry.

Inversely, a mixture is said to be lean when the amount of fuel is lower than the amount required to obtain the stoichiometric composition of the air/fuel mixture, which is equivalent to saying that the mixture has an excess of air for its stoichiometry.

An oxygen probe 14 is disposed downstream of the catalytic converter 13. This probe allows to determine the presence of oxygen downstream of the catalyst. It is thus possible, by a method which will not be further described, to perform the diagnosis of the catalyst, as required by vehicle certification standards.

Diagnosis unit 20 acquires the signals from the various probes, and controls the various electromechanical actuators necessary for operating the engine. The diagnosis unit 20 comprises has a memory and computational capacity. The diagnosis unit 20 implements the described method.

The method for diagnosing an oxygen probe 14 for a combustion engine 1 includes the following steps:

When an engine's fuel injection 1 is inactive, measuring the output electric voltage from the oxygen probe 14 (step 51), If the measured output electrical voltage of the oxygen probe 14 is greater than a predetermined minimum voltage threshold V1, measuring a pressure prevailing in an intake distributor 8 of the engine 1 (step 52), If the measured pressure in the intake distributor 8 is less than a predetermined minimum pressure threshold Pmini, increasing the pressure to a value greater than the predetermined minimum pressure threshold Pmini (step 53), Determining the time period T between the time when the output electrical voltage of the probe falls below a second predetermined voltage threshold V2 and the time when the output electrical voltage of the probe falls below a third predetermined voltage threshold V3 (step 54), and diagnosing the oxygen probe 14 depending on elapsed the time period T (step 55).

This method is implemented only when the probe delivers a voltage higher than a minimum threshold; i.e. when the gas composition is a rich mixture. The selected value for V1 is about 700 millivolts.

If the pressure measured in the intake distributor is insufficient, this pressure in increased, using methods to be detailed below.

The predetermined minimum value Pmini is calculated continuously throughout the diagnosis phase. Indeed, the engine rpm may change between the beginning and the end of the of the oxygen probe diagnosis phase, and it is desirable to update the minimum value of the pressure in the intake distributor.

Once the transition time required for the probe voltage to change from the second electric voltage threshold to the third electric voltage threshold is determined, the state of the oxygen probe can be directly inferred.

By ensuring a minimum pressure in the intake distributor, the dispersion that affects the switching time of the oxygen probe is reduced. Thus, the reliability of the diagnosis is improved.

According to a preferred embodiment, an increase of the pressure measured in the intake distributor 8 is obtained by changing the angular position of a rotary flap 7 disposed at the entry point of the intake distributor 8. An increase in the angle of the flap 7 increases the pressure in the distributor. Action on the angular position of the flap makes it possible to quickly and accurately change the amount of pressure in the intake distributor.

Ideally, the diagnosis method involves the following step:

If the time period T is greater than a maximum predetermined threshold Tmax, diagnosing that oxygen probe 14 has a reaction time that is abnormally slow.

Figure 3:
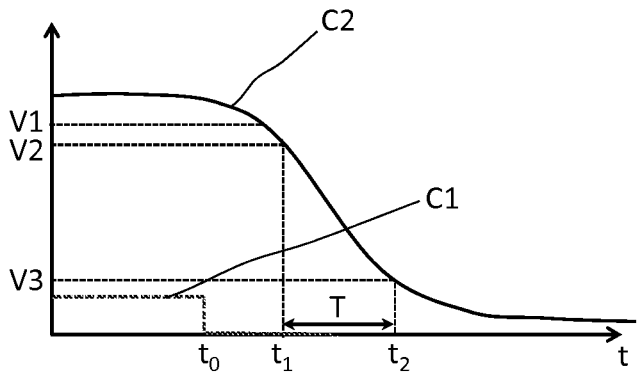
FIG. 3 represents the temporary change in the electric voltage provided by the oxygen probe at the time of a change in oxygen concentration.

FIG. 3 depicts the change over time of the electric voltage of an oxygen probe as the gas mixture surrounding the probe changes from rich to lean.

Curve C1 depicts the richness of the gas. Until time $t_0$, the amount of fuel delivered to the engine is adapted so that the composition of the exhaust gas is rich. At time $t_0$, the fuel supply is stopped so that there is no combustion, and the exhaust gases are thus only air, starting at time $t_0$. The electric voltage delivered by the probe, as illustrated by curve C2, changes from the level of rich composition, about 700 millivolts, to the level of lean composition, about 100 millivolts. This change is not instantaneous, because of two phenomena: the time required for the gases exiting the engine to reach the probe, and the reaction time of the probe itself. The probe's reaction time is estimated by calculating the time T elapsed between $t_1$ and $t_2$, with these two times corresponding respectively to the crossing of thresholds V2 and V3. When time T is greater than the predetermined threshold Tmax, this means that the probe is defective because it is abnormally too slow.

As the probe ages, its response time tends to increase, because its structure becomes less permeable to oxygen.

According to another embodiment, the variable used in the calculations is the slope of the electric voltage curve of the oxygen probe as a function of the time, i.e. the speed of the change of the electric voltage of the oxygen probe.

According to a preferred embodiment, the predetermined minimum pressure threshold depends on the engine rpm. The dispersion affecting the transition time of the oxygen probe is strongly affected by the engine rpm. By varying the minimum pressure based on rpm during the oxygen probe diagnosis phase, it is possible to improve the reliability of the diagnosis over the range of rpms.

Figure 4:
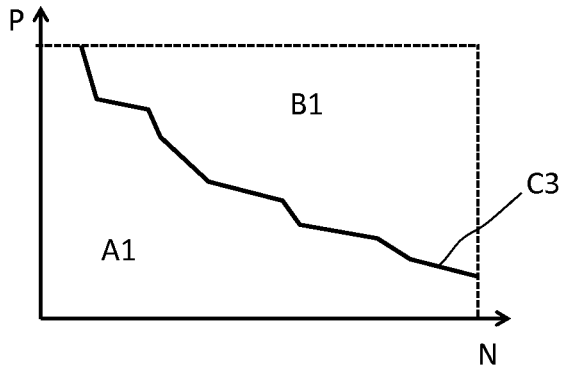
FIG. 4 depicts the reliability of the oxygen probe over the engine operating area.

FIG. 4 shows the reliability of the diagnosis according to the engine operating area. The horizontal axis corresponds to the engine rpm and the vertical axis corresponds to the pressure measured in the intake distributor.

Area B1 corresponds to the operating points where the probe diagnosis is the most reliable, because there is little dispersion in its switching time in this area.

Area A1 corresponds to the area where the diagnosis is the least reliable, because there is a lot of dispersion in this area. Curve C3 depicts the boundary between these two zones.

The farther an operating point, defined by the engine rpm and the pressure in the intake distributor, is from curve C3, while being located in area B1, the more reliable the diagnosis is. Thus, the described method makes it possible, by increasing the pressure in the intake distributor 8, to move from area A1, where the diagnosis is unreliable, to area B1, where the diagnosis is reliable.

Note that the lower the engine rpm, the more the pressure in the intake distributor 8 must be raised in order to obtain a reliable diagnosis.

Figure 5:
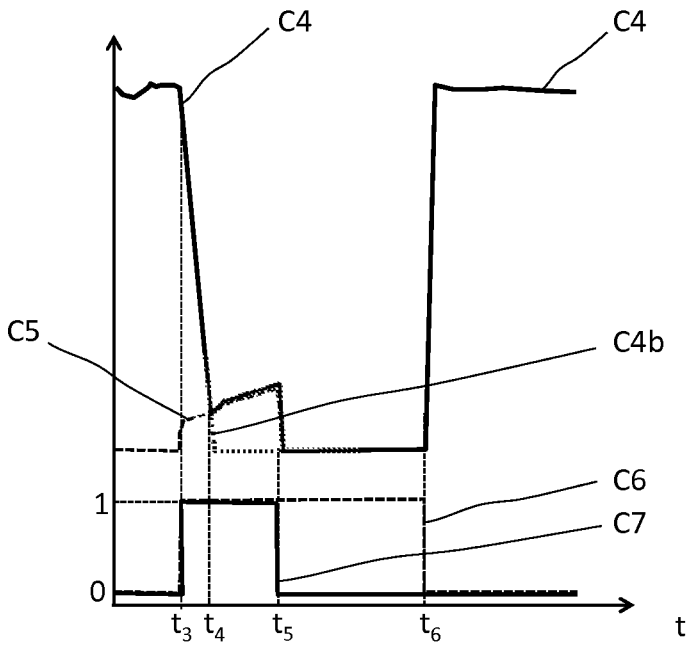
FIG. 5 represents the temporary change in various parameters during an example of one of the implemented methods.

FIG. 5 shows an example of the implementation of the method. Curve C4 depicts the temporal evolution of the pressure in the intake distributor during deceleration and a fuel injection cut-off, when the method is active.

Curve C4*b* depicts the evolution of the same parameters, when the method is shut down.

Curve C5 depicts the evolution of the minimum expected pressure for performing the diagnosis of the probe when the method is active.

Curve C6 depicts the state of the fuel injection.

Curve C7 depicts the activation of the probe diagnosis.

Time $t_3$ is the beginning of a deceleration phase, controlled by the driver of the vehicle. The throttle valve closes, so that the pressure in the intake distributor 8, visible on Curve C4, begins to decrease. At the same time, the fuel supply to the motor is stopped, as depicted by Curve C6, which means that the fuel injection cut-off is active when Curve C6 is in state 1. The diagnosis phase of the oxygen probe begins, as is illustrated by the passage of the C7 curve to state 1.

Curve C5 depicts the minimum pressure that must be present in the intake distributor 8 to obtain a reliable diagnosis. Until time $t_4$, the pressure in the intake distributor is greater than the expected minimum value. After time $t_4$, when the method is not active, the pressure in the intake distributor falls below the minimum value, as shown in the dashed curve C4*b*.

When the method according to the invention is active, after time $t_4$, a further opening of valve 7 occurs, so that between times $t_4$ and $t_5$, the pressure measured in the intake distributor, shown in a solid line, coincides with the expected minimum value, showed in a dotted line. Thus, the reliability of the diagnosis is increased.

At time $t_5$, the diagnosis is completed, and curve C7 returns to state 0. It is thus no longer necessary to ensure a minimum pressure in the intake distributor 8. The additional opening applied to the flap 7 is removed, and the pressure in the intake distributor 8 returns to the same level as when the method is not activated.

At time $t_6$ the driver re-accelerates, causing an increase in the pressure in intake distributor 8 and the resumption of the fuel supply.

The increase in the pressure measured in the intake distributor 8 can also be obtained by changing the angular phasing between a camshaft of the engine 1 and a crankshaft of the engine 1, with the camshaft actuating the intake valves of engine 1. For this purpose, the variable valve actuator 16 is activated.

The increase in the pressure measured in the intake distributor 8 can also be obtained by changing the angular phasing between a camshaft of the engine 1 and a crankshaft of the engine 1, with the camshaft operating the intake valves of engine 1. As above, the variable valve actuator 17 is operated.

It is possible to act only on the intake valves, or only on the exhaust valves, or on the intake and exhaust valves together.

The action on variable valve actuators 16 and 17 can be combined with action on the opening of the intake flap 7.

Preferably, the second predetermined electric voltage threshold V2 is between 500 and 700 millivolts, more preferably between 580 and 620 millivolts. This threshold is close to the electric voltage delivered when there is almost no oxygen in the exhaust gas, i.e. when the mixture is rich.

Preferably, the third predetermined electric voltage threshold V3 is between 200 and 400 millivolts, more preferably between 280 and 320 millivolts. This threshold is at a level close to that of the electric voltage delivered when the oxygen concentration is close to that of the ambient air, i.e. when there is no combustion in the engine.

Preferably, V2 and V3 are selected so that the average of V2 and V3 is 450 mV. In other words, V2 and V3 are spaced by the same amount with respect to the electric voltage delivered when the mixture is stoichiometric.

Preferably, the diagnosis method contains the following step:

before measuring the output electric voltage of the oxygen probe 14, checking that an estimated temperature of the oxygen probe 14 is greater than a predetermined minimum threshold temperature Temp (step 50).

The behavior of the probe is not representative if its active ceramic element has not reached its nominal operating temperature. It cannot, therefore, perform the diagnosis of the probe until it reaches a temperature close to its nominal temperature. The oxygen probe is partially heated by the exhaust gases, and also has a heating element similar to an electrical resistor. Thus, the temperature of the active element of the probe can be precisely regulated by selectively controlling the activation and deactivation of the heating element.

According to one embodiment that is not shown, the combustion engine 1 is a direct-ignition engine.

According to one embodiment that is not shown, the combustion engine 1 is supplied with fuel in a gaseous state.

According to one embodiment that is also not shown, the combustion engine 1 contains a supercharging device arranged to increase the pressure of the gases upstream of their intake into the engine 1.

These latter characteristics can be present independently of each other or in combinations.

The invention claimed is:

1. A method for diagnosing an oxygen probe of a combustion engine, the method comprising:

measuring an output electric voltage from the oxygen probe, when a fuel injection of an engine is inactive;

measuring a pressure prevailing in an intake distributor of the engine when the measured output electric voltage of the oxygen probe is greater than a predetermined minimum voltage threshold;

increasing the pressure to a value greater than a predetermined minimum pressure threshold when the measured pressure in the intake distributor is less than the predetermined minimum pressure threshold;

determining the time period between a time when the output electrical voltage of the probe falls below a second predetermined voltage threshold and a time when the output electrical voltage of the probe falls below a third predetermined voltage threshold, after the pressure is increased; and diagnosing the oxygen probe depending on the elapsed time period.

2. The diagnosis method according to claim 1, wherein an increase of the pressure measured in the intake distributor is obtained by changing the angular position of a rotary flap disposed at an entry point of the intake distributor, an increase in the angular position of the flap increasing the pressure in the distributor.

3. The diagnosis method according to claim 1, wherein the diagnosing the oxygen probe comprises:

diagnosing that the oxygen probe has a reaction time that is abnormally slow when the time period is greater than a maximum predetermined threshold.

4. The diagnosis method according to claim 1, wherein the predetermined minimum threshold depends on the engine rpm.

5. The diagnosis method according to claim 1:

before measuring the output electric voltage of the oxygen probe, checking that an estimated temperature of the oxygen probe is greater than a predetermined minimum threshold temperature.

6. The diagnosis method according to claim 1, wherein the oxygen probe is disposed upstream of a pollutant catalytic converter.

7. A diagnosis unit implementing the method according to claim 1.

8. An assembly comprising:

a combustion engine having an exhaust system in which is disposed an oxygen probe configured to provide a variable output electric voltage based on an oxygen concentration of gases passing through the exhaust system; and the diagnosis unit according to claim 7, configured to diagnose operating of the oxygen probe.

9. The assembly according to claim 8, wherein the combustion engine contains a recirculation system configured to recirculate a part of the gas passing through the exhaust system toward the intake system.

10. The diagnosis method according to claim 2, wherein the diagnosing the oxygen probe comprises:

diagnosing that the oxygen probe has a reaction time that is abnormally slow when the time period is greater than a maximum predetermined threshold.

11. The diagnosis method according to claim 2, wherein the predetermined minimum threshold depends on the engine rpm.

12. The diagnosis method according to claim 3, wherein the predetermined minimum threshold depends on the engine rpm.

13. The diagnosis method according to claim 2:

before measuring the output electric voltage of the oxygen probe, checking that an estimated temperature of the oxygen probe is greater than a predetermined minimum threshold temperature.

14. The diagnosis method according to claim 3:

before measuring the output electric voltage of the oxygen probe, checking that an estimated temperature of the oxygen probe is greater than a predetermined minimum threshold temperature.

15. The diagnosis method according to claim 4:

before measuring the output electric voltage of the oxygen probe, checking that an estimated temperature of the oxygen probe is greater than a predetermined minimum threshold temperature.

16. The diagnosis method according to claim 2, wherein the oxygen probe is disposed upstream of a pollutant catalytic converter.

17. The diagnosis method according to claim 3, wherein the oxygen probe is disposed upstream of a pollutant catalytic converter.

18. The diagnosis method according to claim 4, wherein the oxygen probe is disposed upstream of a pollutant catalytic converter.

19. The diagnosis method according to claim 5, wherein the oxygen probe is disposed upstream of a pollutant catalytic converter.

20. A diagnosis unit implementing the method according to claim 2.

* * * * *